US006828738B2

(12) United States Patent
Grinneiser

(10) Patent No.: US 6,828,738 B2
(45) Date of Patent: Dec. 7, 2004

(54) ENERGY-SAVING LIGHT MARKING DEVICE WITH LOW POWER CONSUMPTION

(75) Inventor: Raymond Grinneiser, Valbonne (FR)

(73) Assignee: Augier S.A., Carros Cedex (FR)

( * ) Notice: Subject to any disclaimer, the term of this patent is extended or adjusted under 35 U.S.C. 154(b) by 37 days.

(21) Appl. No.: 10/399,893

(22) PCT Filed: Oct. 22, 2001

(86) PCT No.: PCT/FR01/03269

§ 371 (c)(1),
(2), (4) Date: Apr. 23, 2003

(87) PCT Pub. No.: WO02/35489

PCT Pub. Date: May 2, 2002

(65) Prior Publication Data

US 2004/0095080 A1 May 20, 2004

(30) Foreign Application Priority Data

Oct. 23, 2000 (FR) ..... 00 13539

(51) Int. Cl.[7] ..... H05B 41/16

(52) U.S. Cl. ..... 315/289; 315/282; 315/277; 315/255; 315/274

(58) Field of Search ..... 315/121, 122, 315/177, 255, 256, 274, 277, 279, 282, 289; 362/410, 387

(56) References Cited

U.S. PATENT DOCUMENTS

| | | | | |
|---|---|---|---|---|
| 3,984,069 A | * | 10/1976 | Heyworth | 244/114 R |
| 4,847,536 A | * | 7/1989 | Lowe et al. | 315/127 |
| 5,397,963 A | | 3/1995 | Manson | 315/129 |
| 5,590,956 A | * | 1/1997 | Messana et al. | 362/410 |
| 6,570,345 B1 | * | 5/2003 | Munson et al. | 315/274 |

FOREIGN PATENT DOCUMENTS

| | | |
|---|---|---|
| EP | 0 587 923 | 3/1994 |
| WO | WO 92/04757 | 3/1992 |

* cited by examiner

*Primary Examiner*—Haissa Philogene
(74) *Attorney, Agent, or Firm*—James C. Lydon

(57) ABSTRACT

An energy-saving light marking device with low power consumption including a head transformer (10) where the primary winding (12) is powered by an alternating current source and several marking lamps in series (14-1 to 14-3) connected to the terminals of the secondary winding (13) of the head transformer, each of the marking lamps being a fluorescent lamp (16-1 to 16-3) powered by the secondary winding of a second transformer (18-1 to 18-3), the primary windings of all the secondary transformers of the marking lamps being connected in series between the terminals of the head transformer's secondary winding (13). The starting of each of the fluorescent lamps (16-1 to 16-3) is provided by the voltage surge generated at the terminals of the secondary winding of the secondary transformers (18-1 to 18-3) when the primary winding of the secondary transformers is powered while the lamps are not yet started.

8 Claims, 3 Drawing Sheets

ENERGY-SAVING LIGHT MARKING DEVICE WITH LOW POWER CONSUMPTION

This application is a U.S. National Stage of International application PCT/FR01/03269, filed Oct. 22, 2001 and published on May 2, 2002 in the French Language.

TECHNICAL FIELD

This invention concerns construction site light marking devices in which the marking lamps are arranged in series along a looped circuit and specifically concerns an energy-saving light marking device with low power consumption.

BACKGROUND ART

There are three types of light marking devices used for identifying work being performed at airports, and more particularly on taxiways.

The first type of lighting system is a standalone device featuring a certain number of individual lights powered by storage batteries generally placed on a metallic support based. Although compact type fluorescent sources are used (generally, a 5 W fluorescent bulb), thus consuming little energy while providing minimum lighting with low power consumption, this device has an autonomy of approximately 12 hours. In order to offset this major drawback, the equipment which makes up this lighting device is generally doubled in order to always have one set of lights being recharged, and one being used. In addition, in order to ensure reliable installation on the tarmac, this device is generally completed by a system of heavy and stable metal bases. These two drawbacks thus make this standalone device poorly adapted to semi-permanent installations (>3 days). An installation of this type requires frequent changing operations and results in high acquisition and battery maintenance costs.

The second type of lighting system features a certain number of 220VAC lights, interconnected by extension cords. The lights are almost always fabricated by the airport's technical department itself and consist of traditional "above-ground" lights, whose internal marking light type lamp base has been replaced by a standard screw or bayonet-type socket for a 40 or 60 W bulb. The socket is connected to a male connector and a 220 V female plug, generally watertight, designed to be connected to the extension cords. The assembly is secured to a metal base which provides support. Such a device presents a certain number of drawbacks. Firstly, its installation requires very long 220 V extension cords made using commercially-available hardware (1.5 to 2.5 $mm^2$ cable with ground, rubber watertight connectors and sockets) as this device often must deal with the lack of power sources (220V) available near the location where the light marking is to be done. In addition, the service life of the majority of these extension cords is short due to the passage of miscellaneous vehicles. These drawbacks make this device costly and unreliable.

The third type of light marking offsets the drawbacks of the previous devices by using an existing lighting loop, such as a runway lighting loop at an airport, for example. It consists in adding an additional current transformer in the lighting system's primary circuit, meant to be used as the head transformer. This light marking device consists of 30 to 65 W standard marking lamps (halogen or filament lamps), and thus requires a head transformer of approximately 500 W for roughly ten lamps. The wiring is generally made on site, for occasional needs, and the series connection of the lamps requires that numerous watertight junctions be made. Wiring such a device generally requires that a loop be "custom made". The last type of lighting, derived from and similar to the third type described above, consists in using a head transformer, the primary winding of which is powered by an alternating current source and whose secondary winding powers a plurality of current transformers. A lamp is connected to each secondary winding of all the transformers and all the primary windings of all the transformers are connected in series to the secondary winding of the head transformer. The major drawback of this type of lighting device connected in series is that it requires a substantial power increase from the existing loops to which it is connected. The use of fluorescent lamps instead of incandescent or halogen lamps reduces the amount of current required by the system although requires a high voltage value at the lamp terminals to start them, generated by a lamp starter. The latter consists primarily of a starter and a ballast. The starter is used to start the system, i.e. heating two electrodes located at the ends of the lamp, and the ballast creates an initial surge voltage which allows the flow of electrons to move through the lamp, which is generally tubular in shape. Once started, the voltage required at the terminals of the fluorescent lamp is lower.

DISCLOSURE OF THE INVENTION

This is why an initial purpose of the invention is to provide a lighting device using fluorescent lamps that do not require lamp starters.

A second purpose of the invention is to provide a lighting device that requires only a small amount of power while providing satisfactory light intensity.

Another purpose of the invention is to provide a temporary light marking device which can be inserted into an existing runway lighting loop without an excessive increase in power.

The purpose of the invention is thus an energy-saving light marking device with low power consumption including a head transformer, the primary winding of which is supplied by an alternating current source and a plurality of marking lamps in series connected to the terminals of the secondary winding of the head transformer, each of the marking lamps being comprised of a fluorescent lamp powered by the secondary winding of a secondary transformer, the primary windings of all the secondary transformers of the marking lamps being connected in series between the terminals of the head transformer's secondary winding. According to the main characteristic of the invention, each of the fluorescent lamps is started by the voltage surge generated at the terminals of the secondary winding of the secondary transformers when the primary winding of the secondary transformers is energized while the lamps are not yet started.

BRIEF DESCRIPTION OF DRAWINGS

The purposes, objects and characteristics of the invention will become more apparent from the following description when taken in conjunction with the accompanying drawings in which.

DETAILED DESCRIPTION OF THE INVENTION

Figure 1:
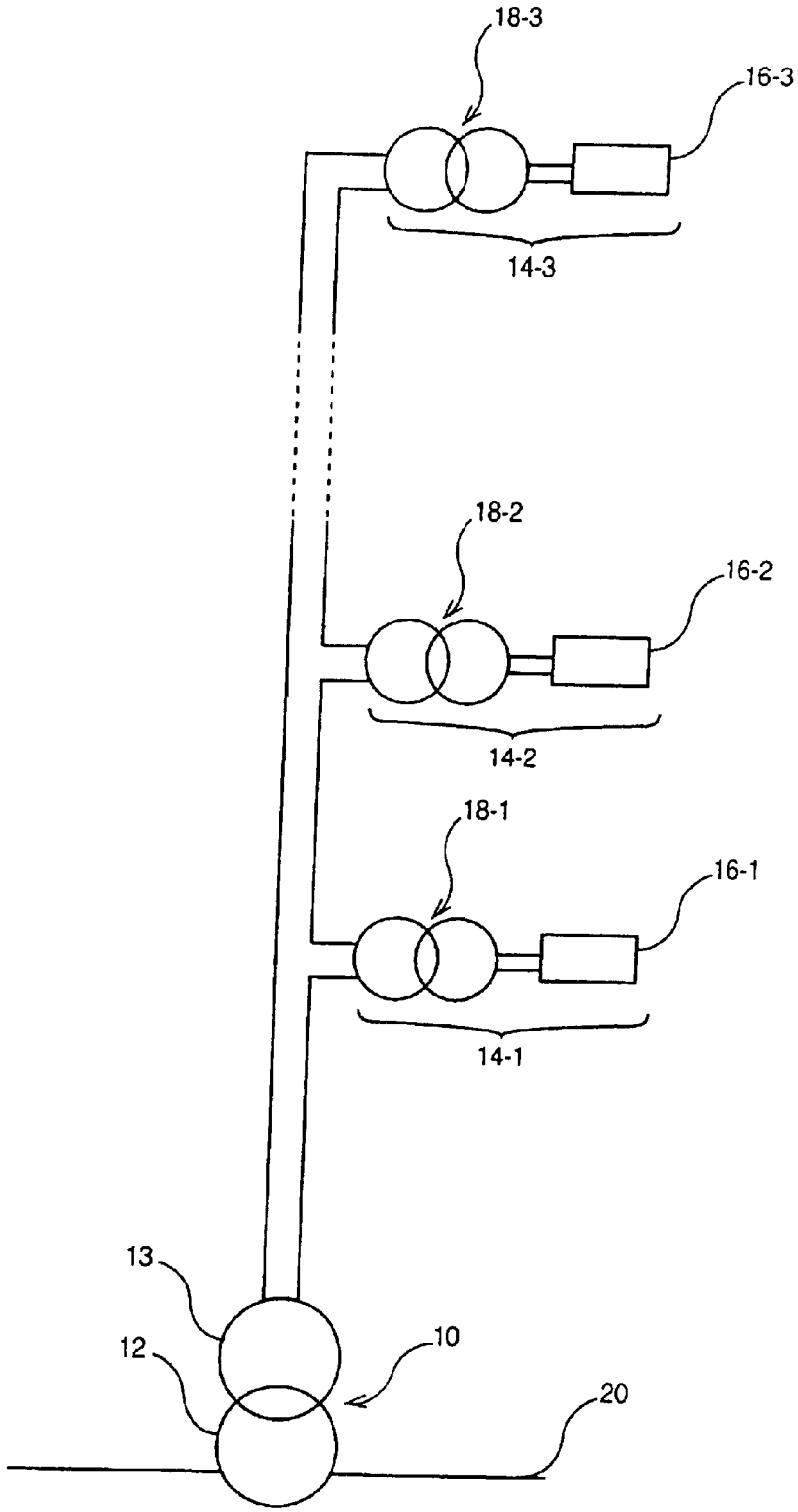
FIG. 1 represents a runway lighting loop in which the device of the invention is used.

The light marking device according to the invention is shown schematically in FIG. 1. A head transformer 10, up to 200 w, is supplied by a 6.6 A, for example. The marking lamps 14-1 to 14-3 are connected in series to the secondary winding of the head transformer. It should be noted that the transformer 10 is a current transformer with a ratio of 1/1. Each marking lamp primarily consists of a transformer and a fluorescent lamp. The fluorescent lamps 16-1 to 16-3 are powered by the secondary windings of transformers 18-1 to 18-3 respectively, in turn connected in series by their primary windings between the terminals of the secondary winding 13 of the head transformer 10.

According to a preferred embodiment of the invention, the current which powers the light marking device is supplied by the primary circuit 20 from an existing airport circuit including the primary winding 12 of the head transformer 10. It goes without saying that the current powering the light marking device may be supplied by a standalone alternating current electrical source such as a current generator.

Figure 2:
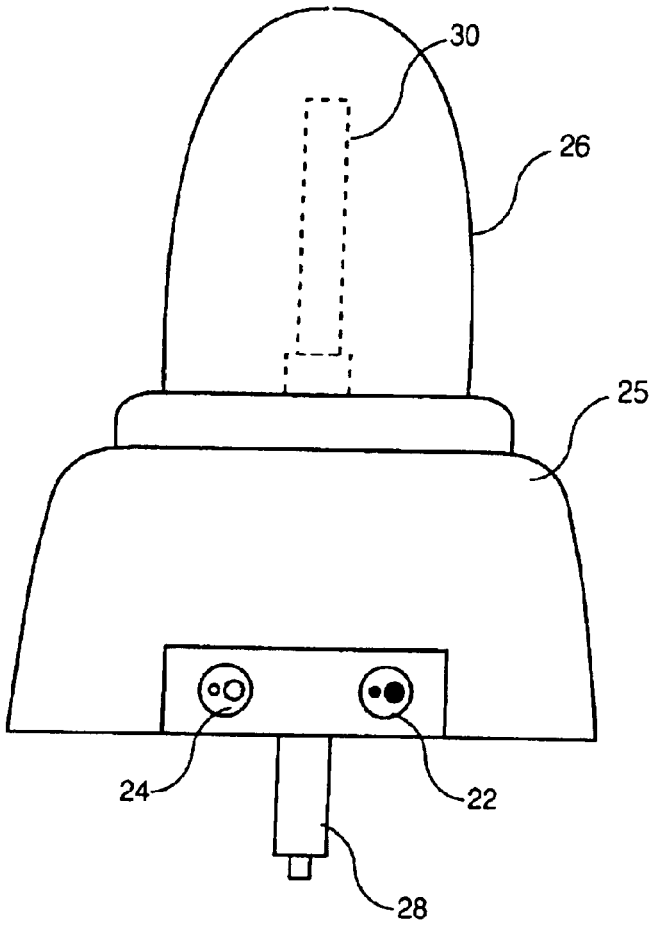
FIG. 2 represents an example of a marking lamp according to the invention, as seen from the front.

Each marking lamp, illustrated in FIG. 2, features an overmolded male connector 22 and an overmolded female plug 24. In this manner, the marking lamps are connected together by male-female extension cords in compliance with FAA (Federal Aviation Administration) standards. The first extension cord connects the secondary winding of the head transformer to the overmolded male connector 22 of the first marking lamp, the next extension cord connects the female plug 24 of the first marking lamp to the male connection of the following marking lamp, and so forth up to the last light whose overmolded female plug is fitted with a short-circuit cap.

Still in accordance with the example illustrated in FIG. 2, each marking lamp includes a body 25 on which is mounted a hermetic cover glass 26 (shape and color adapted as required) containing a 5 to 11 W fluorescent lamp (typically 9 W). The lamp transformer 18 (not shown in FIG. 2) is connected electrically in series between one of the 2 terminals (preferably the smallest) of the overmolded male connector 22, and the corresponding terminal of the overmolded female plug 24. The other terminals of the male and female connectors (preferably the largest) are connected together directly. This device allows the current from the head transformer to be transformed into an arc current for the light source.

Figure 3:
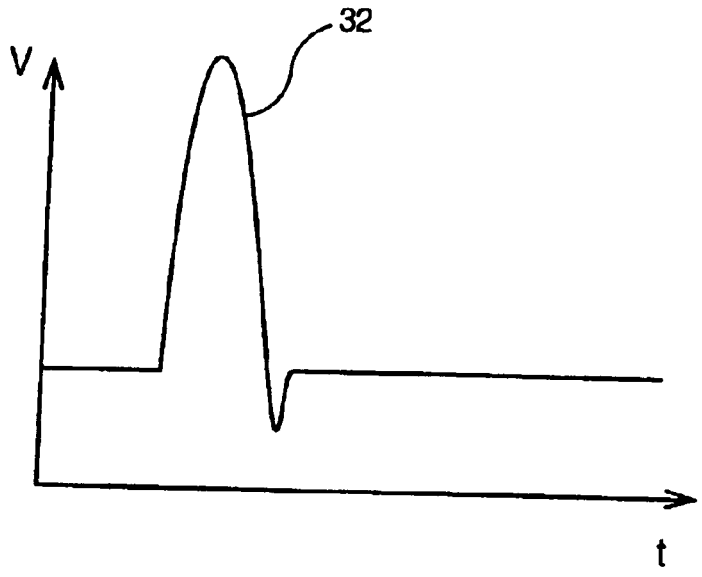
FIG. 3 represents a voltage vs. time diagram of the marking lamp transformer.

When no current is circulating in the secondary winding of the marking lamps, the lights are off as there is no current at their terminals. When current circulates in the primary winding of the lamp transformer, it rapidly creates a voltage surge 32 on the transformer's secondary winding terminals, as shown in FIG. 3, by saturation of the magnetic circuit. This voltage surge creates an arc between the lamp's two electrodes and thus turns it on.

The manner in which the light is secured to the ground 28 may be one of the two means described below or any other ground mounting means. The first means is a stake support, which screws into the bottom of the light and the second is a removable tripod support providing stability. The assembly can include a carrying device, such as handle for example. It should also be noted that each overmolded plug 22 and 24 includes a built-in decompression device preventing the air trapped inside when the extension cord is connected from creating a pulling force that could facilitate a disconnection.

While the preferred embodiment of the invention is a temporary light marking device which connects to the primary circuit of a runway lighting system, it goes without saying that the device according to the invention may be used in any other application and in particular as a permanent light marking system for airport runways.

It should be noted that the light marking device according to the invention uses fluorescent lamps which characteristically emit the same light intensity as traditional filament lamps with 4 to 5 times less power. In this manner, the use of fluorescent lamps reduces power consumption by 4 to 5 times in relation to traditional filament lamps, and also enables the light marking device to be connected to a primary loop of an existing light marking system without an increase in power.

What is claimed is:

1. An energy-saving light marking device with low power consumption comprising a head transformer having a primary winding and a secondary winding;

an alternating current source which powers said primary winding of said head transformer;

and a plurality of marking lamps in series connected to terminals of the secondary winding of said head transformer, each of said marking lamps comprising a fluorescent lamp powered by a secondary winding of a secondary transformer, the primary windings of all the secondary transformers of the marking lamps being connected in series between the terminals of said head transformer's secondary winding;

wherein the starting of each of said fluorescent lamps is produced by a voltage surge generated at the terminals of the secondary windings of said secondary transformers when the primary winding of said secondary transformers is powered while the lamps are not yet started.

2. The device of claim 1, wherein said head transformer is included in a primary circuit of an airport runway light marking system.

3. The device of claim 1, wherein the primary winding of said head transformer is connected to the terminals of a stand-alone alternating current power source.

4. The device of claim 3, wherein said alternating power source is a current generator.

5. The device of claim 1, wherein each of said light marking lamps comprises a body on which a hermetic cover glass is mounted containing a fluorescent lamp.

6. The device of claim 1, wherein each of said marking lamps includes an overmolded female plug and an overmolded male connector, said lamps being connected together by means of extension cords, in turn connected to said overmolded male and female connectors of the light marking lamps.

7. A use of the device of claim 1 as a temporary light marking device.

8. A use of the device of claim 1 as a permanent light marking device for airport runways.

* * * * *